US007178269B2

(12) United States Patent
Bauerfeind et al.

(10) Patent No.: US 7,178,269 B2
(45) Date of Patent: Feb. 20, 2007

(54) INSOLE FOR FOOTWEAR

(75) Inventors: Hans B. Bauerfeind, Zeulenroda (DE); Holger Reinhardt, Kempten (DE)

(73) Assignee: Bauerfeind AG, Zuelenroda (DE)

( * ) Notice: Subject to any disclaimer, the term of this patent is extended or adjusted under 35 U.S.C. 154(b) by 0 days.

(21) Appl. No.: 11/065,302

(22) Filed: Feb. 25, 2005

(65) Prior Publication Data

US 2005/0193591 A1 Sep. 8, 2005

(30) Foreign Application Priority Data

Feb. 25, 2004 (DE) ..... 20 2004 002 870 U

(51) Int. Cl.
*A43B 13/12* (2006.01)
*A43B 13/38* (2006.01)

(52) U.S. Cl. ..... 36/30 A; 36/43

(58) Field of Classification Search ..... 36/30 A, 36/43, 44
See application file for complete search history.

(56) References Cited

U.S. PATENT DOCUMENTS

| | | | | | |
|---|---|---|---|---|---|
| 1,592,445 | A | * | 7/1926 | Cutler | 12/142 R |
| 2,337,169 | A | * | 12/1943 | Swart | 442/104 |
| 2,410,019 | A | * | 10/1946 | Davis | 36/28 |
| 2,546,827 | A | * | 3/1951 | Lavinthal | 36/154 |
| 2,863,231 | A | * | 12/1958 | Jones | 36/174 |
| 3,233,348 | A | * | 2/1966 | Gilkerson | 36/44 |
| 3,544,525 | A | | 12/1970 | Balint et al. | 260/75 |
| 3,821,135 | A | * | 6/1974 | King | 36/30 A |
| 5,438,768 | A | * | 8/1995 | Bauerfeind | 36/44 |
| 2001/0039746 | A1 | | 11/2001 | Selter | 38/44 |
| 2005/0085620 | A1 | | 4/2005 | Bruckmann | 528/480 |

FOREIGN PATENT DOCUMENTS

| | | |
|---|---|---|
| DE | 198 01 301 A1 | 11/1998 |
| DE | 198 30 121 A1 | 1/2000 |
| DE | 198 48 245 | 5/2000 |
| DE | 198 57 568 A1 | 6/2000 |

* cited by examiner

*Primary Examiner*—Ted Kavanaugh
(74) *Attorney, Agent, or Firm*—Steptoe & Johnson LLP

(57) ABSTRACT

An insole for footwear comprising silicone with a filler material, having a selected region of a silicone-cork mixture with a sufficiently high proportion of cork that the height thereof can be formed by grinding.

4 Claims, 1 Drawing Sheet

INSOLE FOR FOOTWEAR

The invention relates to an insole for footwear, which insole comprises silicone with a filler material.

BACKGROUND OF THE INVENTION

An insole is described in European Patent Specification 0 140 984, formed fro a mixture of silicone rubber and organic filler. This material mixture extends throughout the entire insole, the insole thus being a homogeneous body.

Another insole is disclosed in DE 198 57 568 A1, that insole consisting of a carbon material for stiffening an elastic forefoot, which due to is thickness was also intended to facilitate rolling motion of the foot. That insole had a cork heel pad glued to the ball portion of the insole. That patent specification also made reference to other forms of connection between the ball portion and the heel portion, e.g. an interlocking of the two parts.

BRIEF SUMMARY OF THE INVENTION

An object of the invention is a continuously elastic insole, comprising silicone, for example, and, certain portions of the insole having a particular support function, and comprising a material which, without foregoing elasticity, allows the insole to be adapted to the particular shape of a patient's foot. This object of the invention is achieved by an insole which partially comprises pure silicone and, in a selected region provided for height customization, comprises a silicone-cork mixture, with the proportion of cork being such that the height thereof, as a grindable region, can be customized by grinding.

The silicone-cork mixture in the selection region provides two particularly, desirable effects. First, the relatively high proportion of cork in the silicone-cork mixture allows that region to be ground down, to accommodate the shape of a patient's foot and/or therapeutic need, to the height considered appropriate by the treating physician. This is not possible using only silicone, because silicone alone cannot be ground. On the other hand, the silicone in the cork containing region ensures that this region, too, retains its elasticity, because the individual cork particles are joined together by thin silicone layers which are then readily able to absorb the stresses which occur during bending of the insole. The overall result, therefore, is an extremely customizable insole which is of sufficient elasticity throughout and which is capable of meeting a broad range of desirable insole characteristics.

The region of customizable height may be situated at various places on the insole. For example, it is possible to provide the grindable region at a raised outer edge. A further practical region is a pad disposed in the metatarsal region. Particular importance is also attached to the heel region, which, if formed by the silicone-cork mixture, can be customized within a relatively wide range of variations by grinding to certain heights.

BRIEF DESCRIPTION OF THE DRAWINGS

Illustrative preferred embodiments of the invention are shown in the accompanying drawings, wherein.

DETAILED DESCRIPTION

Figure 1A:
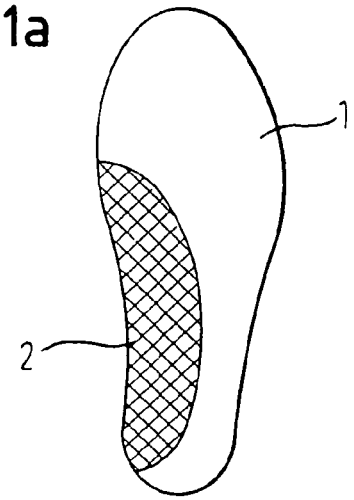
FIG. 1*a* shows the insole with the silicone-cork mixture in the region of a raised outer edge in a top plan view.
Figure 1B:
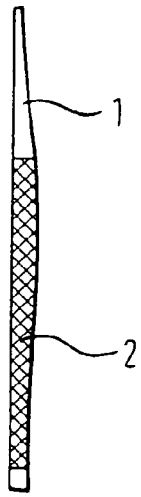
FIG. 1*b* shows the insole in a side view with the silicone-cork mixture in the region of a raised outer edge in a top plan view.

FIG. 1*a* shows the insole 1 in a top plan view, the insole 1 having a raised outer edge 2 in the region which supports the inside of the metatarsal, said raised outer edge 2 comprising a silicone-cork mixture. FIG. 1*b* shows the insole 1 in a side view from the side of the raised outer edge 2, making it apparent that the raised outer edge 2 extends beyond the thickness of the forefoot region 7 and the insole 1. The silicone-cork mixture in the region of the raised outer edge 2 has been ground down to the height shown.

Figure 2A:
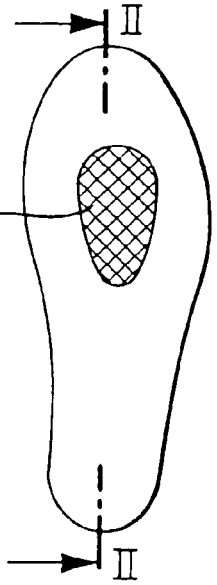
FIG. 2*a* shows the insole with a pad of silicone-cork mixture disposed in the metatarsal region in a top plan view.
Figure 2B:
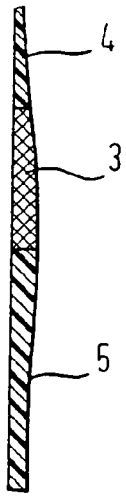
FIG. 2*b* shows the insole in section with a pad of silicone-cork mixture disposed in the metatarsal region.

FIGS. 2*a* and 2*b* show the dimensional extent of a pad 3 of silicone-cork mixture in the metatarsal region, pad 3 having been ground to the thickness shown. FIG. 2*b* shows a section along line II—II of FIG. 2*a*, it being evident therefrom how the forefoot region 4 and the heel region 5 each directly adjoin the pad 3, which, therefore, as shown in FIG. 2*a*, is completely surrounded by the silicone of the insole.

Figure 3A:
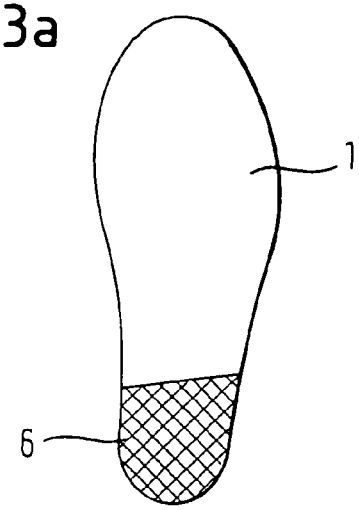
FIGS. 3*a* and 3*b* shows the insole with a silicone-cork mixture in the heel region.
Figure 3B:
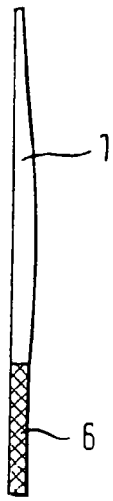

FIGS. 3*a* and 3*b* show the insole 1 with the silicone-cork mixture in the heel region 6, FIG. 3*a* presenting a top plan view and FIG. 3*b* presenting a side view. The height of the cork mixture in the heel region 6, which is customizable by grinding, serves to exert a favourable influence on the rolling behaviour of the foot during walking.

The use of the silicone-cork mixture and forming the remainder of the insole from silicone, provides at the transition points direct homogeneous silicone connections which penetrate from the silicone in regions outside the silicone-cork mixture into the silicone-cork mixture, wherein the silicone encapsulates the cork particles and thus establishes not only a connection with the cork particles, but also a connection with silicone of the other region of the insole itself. Thus, in effect, results, with regard to the silicone, in formation of a homogeneous body from which the regions of silicone-cork mixture are unable to break out during use. The consequence is that there is a continuous elasticity which extends into regions of silicone-cork mixture, with virtually no perceptible step to the transition from silicone to silicone-cork mixture, which counteracts the otherwise possible occurrence of pressure points within an insole.

What is claimed is:

1. An insole for footwear, said insole comprising:

silicone;

a metatarsal region;

a heel region;

and, in a selected region, a silicone-cork mixture comprising a sufficiently high proportion of cork such that said selected region is a grindable region so that the height thereof can be formed by grinding, wherein the silicone encapsulates the cork particles in the region including the silicone-cork mixture, to form a homogeneous body between the silicone insole and the region including the silicone-cork mixture.

2. An insole according to claim 1, wherein the grindable region has a raised outer edge.

3. An insole according to claim 1, wherein the grindable region is a pad located in the metatarsal region of the insole.

4. An insole according to claim 1, wherein the grindable region is located in the heel region of the insole.

* * * * *

UNITED STATES PATENT AND TRADEMARK OFFICE

CERTIFICATE OF CORRECTION

PATENT NO. : 7,178,269 B2
APPLICATION NO. : 11/065302
DATED : February 20, 2007
INVENTOR(S) : Hans B. Bauerfeind et al.

It is certified that error appears in the above-identified patent and that said Letters Patent is hereby corrected as shown below:

On the title page, items [75] and [73] should read:

(75) Inventors: Hans B. Bauerfeind, Zeulenroda (DE);
Holger Reinhardt, Kempen (DE)

(73) Assignee: Bauerfeind AG, Zeulenroda (DE)

Signed and Sealed this

Sixth Day of May, 2008

JON W. DUDAS
*Director of the United States Patent and Trademark Office*